US005595720A

United States Patent [19]

Arai et al.

[11] Patent Number: 5,595,720

[45] Date of Patent: Jan. 21, 1997

[54] METHOD FOR PRODUCING CARBON FIBER

[75] Inventors: Yutaka Arai, Kawasaki; Kunio Miura; Toshihisa Nishikawa, both of Himeji; Mitsuaki Matsumoto, Tsukuba, all of Japan

[73] Assignees: Nippon Steel Corporation; Nippon Steel Chemical Co., Ltd., both of Tokyo, Japan

[21] Appl. No.: 437,921

[22] Filed: May 9, 1995

Related U.S. Application Data

[63] Continuation of Ser. No. 117,531, Sep. 7, 1993, abandoned.

[30] Foreign Application Priority Data

| | | | |
|---|---|---|---|
| Sep. 4, 1992 | [JP] | Japan | 4-260498 |
| Sep. 4, 1992 | [JP] | Japan | 4-260499 |
| Sep. 11, 1992 | [JP] | Japan | 4-267842 |

[51] Int. Cl.$^6$ ..... D01D 5/098

[52] U.S. Cl. ..... 423/447.6; 264/29.6

[58] Field of Search ..... 423/447.6, 447.1; 264/29.6

[56] References Cited

U.S. PATENT DOCUMENTS

| | | | |
|---|---|---|---|
| 4,186,179 | 1/1980 | Katsuki et al. | 423/447.6 |
| 4,849,200 | 7/1989 | Vemura et al. | 423/447.6 |
| 4,898,723 | 2/1990 | Suto et al. | 423/447.6 |

FOREIGN PATENT DOCUMENTS

| | | |
|---|---|---|
| 51-12740 | 4/1976 | Japan . |
| 60-21911 | 2/1985 | Japan . |
| 60-126324 | 7/1985 | Japan . |
| 60-259629 | 12/1985 | Japan . |
| 62-133123 | 6/1987 | Japan . |
| 64-33214 | 2/1989 | Japan . |
| 2-6618 | 1/1990 | Japan . |
| 4-91229 | 3/1992 | Japan . |

*Primary Examiner*—Michael Lewis
*Assistant Examiner*—Stuart L. Hendrickson
*Attorney, Agent, or Firm*—Wenderoth, Lind & Ponack

[57] ABSTRACT

A method for producing carbon fiber comprising applying an infusibilization to a pitch fiber yarn made using mesophase pitch as a starting material in a state with substantially no tension applied to the yarn and in an oxidizing gas atmosphere including nitrogen dioxide and oxygen, then sintering in an inert gas atmosphere of 350° C. to less than 400° C. for 10 minutes or more for primary carbonization, then applying secondary carbonization at a temperature of 800° to 1300° C. for 5 to 120 seconds, while feeding out the yarn in the linear form and continuously transporting the same.

3 Claims, 8 Drawing Sheets

METHOD FOR PRODUCING CARBON FIBER

This application is a continuation of Ser. No. 08/117,531 filed Sep. 7, 1993 now abandoned.

BACKGROUND OF THE INVENTION

1. Field of the Invention

The present invention relates to a method for producing carbon fiber, more specifically to a method for stably producing carbon fiber from various types of pitches, without causing breakage of fiber and in mass quantities at a fast speed. The present invention also relates to a method for producing carbon fiber suitable for the production of prepregs and superior in spreading ability of filaments.

2. Description of the Related Art

It is well known that carbon fiber is widely used as a prepreg material. Carbon fiber suitable for prepregs is required to be free from fluff in the fiber bundles, superior in the spreading ability, and long in length.

Pitch fiber, however, is fragile. Even the intermediate process product of infusible fiber is remarkably fragile with a strength of 5 to 10 kgf/mm$^2$, so an infusible fiber yarn comprised of 100 to 100,000 of the filaments bundled together is difficult to handle, easily breaks, a long fiber is difficult to make and there is a lot of fluff.

Further, if the infusible fiber yarn is linearly fed out for carbonization or graphitization, then, as disclosed in Japanese Unexamined Patent Publication (Kokai) No. 4-91229, during the carbonization or graphization, problems will arise that the individual filaments in the fiber yarn will fuse together, the yarn will become rigid, and the quality of the product will otherwise remarkably fall.

In regard to these problems, Japanese Examined Patent Publication (Kokoku) No. 62-20281 describes a method of initial carbonization in a range of 400° to 650° C. after the infusibilization and then handling this initially carbonized fiber. In general, if pitch fiber is treated not to fuse and then carbonized, there are points where the elongation at break of the filaments remarkably rises in a range of temperature of the carbonization treatment of 500° to 600° C. It is known to use this large elongation at break, perform the carbonization in this temperature range, and handle the yarn at that time.

Further, Japanese Unexamined Patent Publication (Kokai) No. 60-126324 describes a method of heating until the elongation at break of the fiber exceeds 2.5%, performing the carbonization, then further performing carbonization and graphitization of the fiber yarn under tension at a higher temperature to produce a carbon fiber bundle (or multifilaments) with a good filament alignment.

On the other hand, as a means for shortening the infusibilization time and otherwise improving the productivity or improving the physical properties of the carbon fiber, a method of using nitrogen dioxide gas for the atmospheric gas at the time of infusibilization is described in Japanese Unexamined Patent Publication (Kokai) No. 60-259629, or a method of further mixing steam in the nitrogen dioxide is described in Japanese Unexamined Patent Publication (Kokai) No. 2-6618.

By using a gas comprised of a mixture of nitrogen dioxide gas in the atmospheric gas at the time of the infusibilization, it becomes possible to remarkably shorten the infusibilization time compared with the infusibilization using air as an atmospheric gas, which has been the general practice in the past.

When using nitrogen dioxide for the atmospheric gas at the time of infusibilization, even if the initial carbonization is performed in the range of 400° to 650° C. as has been generally known in the past, while the elongation at break of the fiber is improved, there are problems that, in this range, the breaking strength is low, yarn breakage occurs, and the handling of the yarn is not improved.

Further, due to the shrinkage of the fibers, the alignment of the fibers was poor and the physical properties appeared unstable. Due to the breakage of the yarn in the graphization process, a reduction in the productivity was caused.

As a method for obtaining a long fiber from fragile pitch fiber, further, Japanese Examined Patent Publication (Kokoku) No. 51-12740 discloses a method of depositing spun fiber on a wire box, performing a infusibilization on the fiber in the state deposited on the box, performing carbonization at a temperature of at least 700° C. to increase the tensile strength of the fiber, then performing carbonization at a temperature of 1500° C. in the linear form. With this method, however, flaws were formed in the yarn at the time of deposition at the stage of the initial carbonization. These flaws were not easily eliminated even in the later carbonization. Therefore, it was only possible to obtain a fiber inferior in terms of the yarn fluff and spreading ability. Japanese Unexamined Patent Publication (Kokai) No. 64-33214 discloses a method of performing carbonization during the shrinkage of the fiber after the infusibilization, that is, at not more than a temperature of 1300° to 1500° C., under a tension of 0 to 50 mg/denier, then performing the graphitization at a degree of stretching 0.1 to 1.2% higher than the spontaneous degree of stretching. With this method, however, when performing the infusibilization by a gas containing nitrogen dioxide, it was not possible to stably obtain a fiber superior in spreading ability.

SUMMARY OF THE INVENTION

The object of the present invention is to provide a method for improving the handling properties, e.g., eliminating breakage of filaments and fusing, without the use of a lubricant etc. and further shortening the treatment time and otherwise improving the productivity when carbonizing and graphitizing an infusible fiber obtained using nitrogen dioxide gas.

Another object of the present invention is to provide a method for efficiently producing a continuous yarn and obtaining a high grade carbon fiber superior in spreading ability and with little fluff of the yarn of the resultant carbon fiber when carbonizing and graphitizing an infusible fiber obtained using nitrogen dioxide gas.

In accordance with the present invention, there is provided a method for producing carbon fiber comprising applying a infusibilization to a pitch fiber yarn made using mesophase pitch as a raw material in a state with substantially no tension applied to the yarn and in an oxidizing gas atmosphere including nitrogen dioxide ($NO_2$) and oxygen ($O_2$), then sintering in an inert gas atmosphere of 350° C. to less than 400° C. for 10 minutes or more for the primary carbonization, then applying secondary carbonization at a temperature of 800° to 1300° C. for 5 seconds to 2 minutes, while feeding out the yarn in the linear form and continuously transporting it.

BRIEF DESCRIPTION OF THE DRAWINGS

The present invention will be better understood from the following description made with reference to the attached drawings, in which.

DESCRIPTION OF THE PREFERRED EMBODIMENTS

Figure 1:
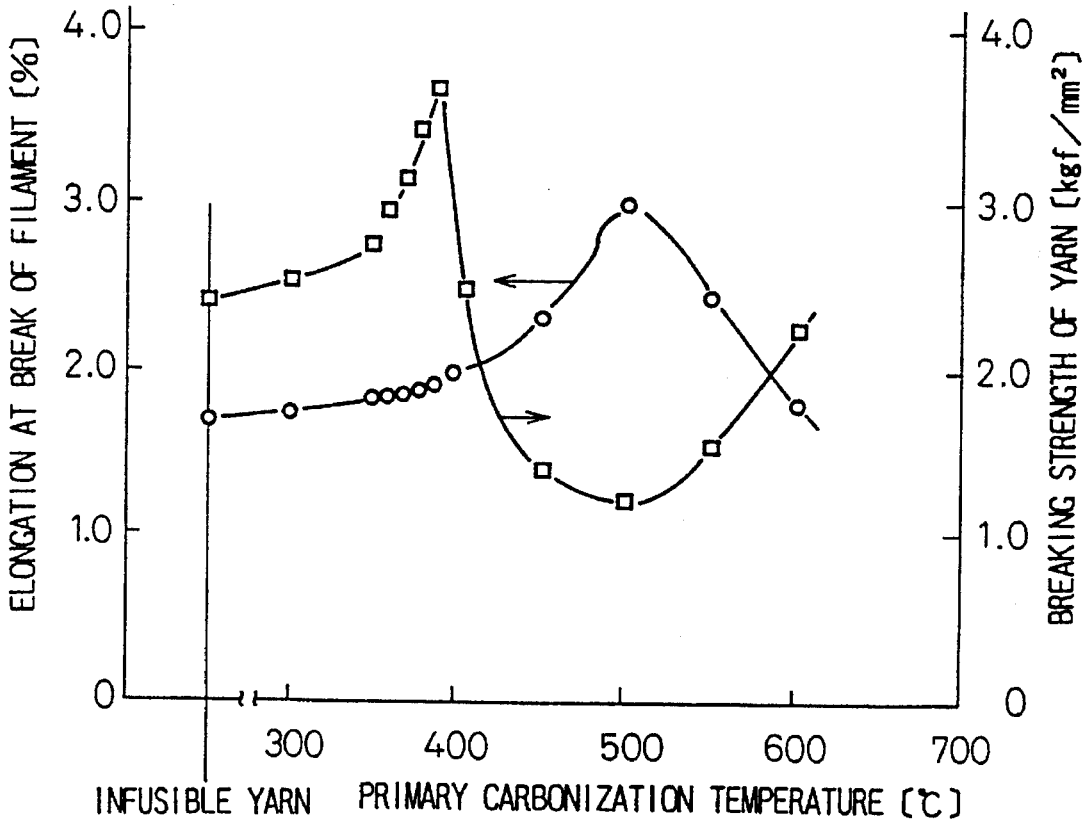
FIG. 1 is a graph illustrating the relationship among the treatment (sintering) temperature in the carbonization treatment, the strength, and the elongation.

Now, the present invention will be explained in detail.

As the pitch used as the starting material of the carbon fiber of the present invention, mention may be made of various types of coal-based pitches such as coal tar, coal tar pitch, coal liquefied pitch, ethylene tar pitch, oil-based pitches such as decant oil pitch obtained from the residual oil of fluidized catalytic cracking, and synthetic pitches prepared from naphthalene etc. using a catalyst etc. Coal tar pitch is preferable.

The mesophase pitch usable for the carbon fiber of the present invention is obtained by subjecting the above-mentioned pitch to heat treatment, hydrogenation, or another known method to cause the occurrence of the mesophase. Mesophase pitch preferably is one with a high orientation of the pitch fiber at the time of spinning, therefore the content of the mesophase is preferably at least 40%, more preferably at least 70%. Also, the mesophase pitch used in the present invention may be one with a softening point of 200° to 400° C., more preferably 250° to 350° C.

The pitch fiber is obtained by subjecting this mesophase pitch to melt spinning by a known method. For example, the above-mentioned mesophase pitch is drawn at a take-up speed of 100 to 2000 m/min while extruding at a temperature exhibiting a viscosity of 100 to 2000 poise from a capillary of a diameter of 0.1 to 0.5 mm and a pressure of 0.1 to 100 kgf/cm$^2$. It is possible to obtain a pitch fiber of a fiber diameter of 5 to 20 μm. The pitch fiber is generally obtained in the form of a bundle of 1,000 to 100,000 pitch fibers bundled together. At this time, it is possible to perform the bundling with a generally known lubricant, but in the case of the present invention, better results are obtained without the use of a lubricant.

In the present invention, the bundle of filaments (or multifilaments) is referred to as "yarn". The pitch fiber yarn, as mentioned before, is generally a bundle of 1000 to 100,000 pitch fiber filaments. The pitch fiber yarn may be taken up on a bobbin and may be deposited on a box or plate in a manner enabling it to be fed out. It is preferable to perform the following infusibilization in this wound up or deposited state.

Next, the pitch fiber yarn is subjected to an infusibilization under conditions of substantially no tension in an oxidizing gas atmosphere containing $NO_2$ and $O_2$. The preferable treatment conditions are an oxidizing gas atmosphere of a concentration of nitrogen dioxide of 2 to 10% by volume, a concentration of oxygen of 2 to 20% by volume, a content, when necessary, of steam of 2 to 10% by volume, and a remaining gas of nitrogen or other inert gas, a temperature of 100° to 320° C., and a treatment time of 30 to 300 minutes, preferably 40 to 200 minutes. Next, the yarn obtained by this infusibilization is subjected to primary carbonization at a temperature of from 350° C. to less than 400° C. for at least 10 minutes in an inert gas atmosphere of nitrogen gas etc. This primary carbonization is performed under conditions of substantially no tension.

FIG. 1 shows the results of measurement of the elongation at break of individual fibers at the time of carbonization of the infusible fiber for 30 minutes while changing the primary carbonization temperature, and the breaking strength of the carbon fiber yarn comprised of a bundle of 3000 filaments. The average value of the elongation at break of the individual fiber filaments exhibits its maximum value at a temperature of about 400° to 650° C., in particular a carbonization temperature of about 500° C. The results are the same as those of past discoveries, but it was learned that the breaking strength of the carbon fiber yarn was gradually improved from the infusible yarn at a sintering temperature of 390° C. and the strength rapidly fell at over 400° C. This phenomenon is deemed a unique phenomenon in the case of use of an atmospheric gas containing $NO_2$ and $O_2$ for the infusibilization.

The present inventor took note of this point and found that it is possible to stably produce carbon fiber in mass quantities and a fast speed by dividing the carbonization into two stages, performing the primary carbonization at 350° C. to less than 400° C., preferably 360° to 390° C. for at least 10 minutes, preferably 20 to 60 minutes, to impart to the yarn a strength preventing yarn breakage even if it is fed out in the linear form and continuously transported, then performing the secondary carbonization at a high temperature of 800° to 1300° C. for a short time of 5 seconds to 2 minutes while continuously transporting the yarn in the linear form.

In this way, there is the advantage that a fiber with a large strength can be obtained at a temperature of 350° C. to less than 400° C. On the other hand, if the carbonization temperature is lower than 350° C., when the secondary carbonization is performed continuously on the yarn at a temperature of 800° to 1300° C. for 5 seconds to 2 minutes, the problem of the fibers fusing together or becoming rigid due to the decomposition products generated during the carbonization occurs.

Therefore, it is necessary to perform the primary carbonization of the infusible fiber once at a temperature of at least 350° C. for at least 10 minutes.

Figure 2:
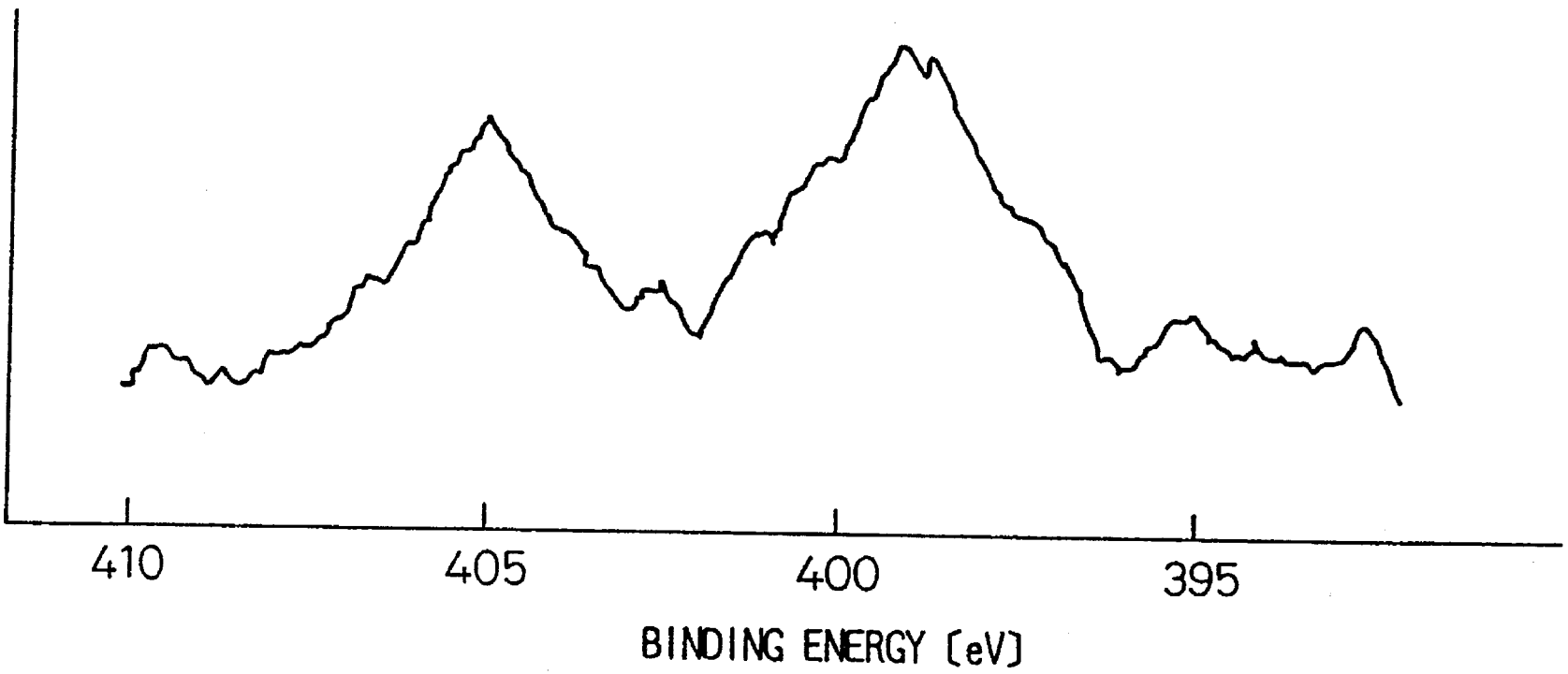
FIG. 2 is a graph of the spectroanalysis of the infusible fiber before carbonization.
Figure 3:
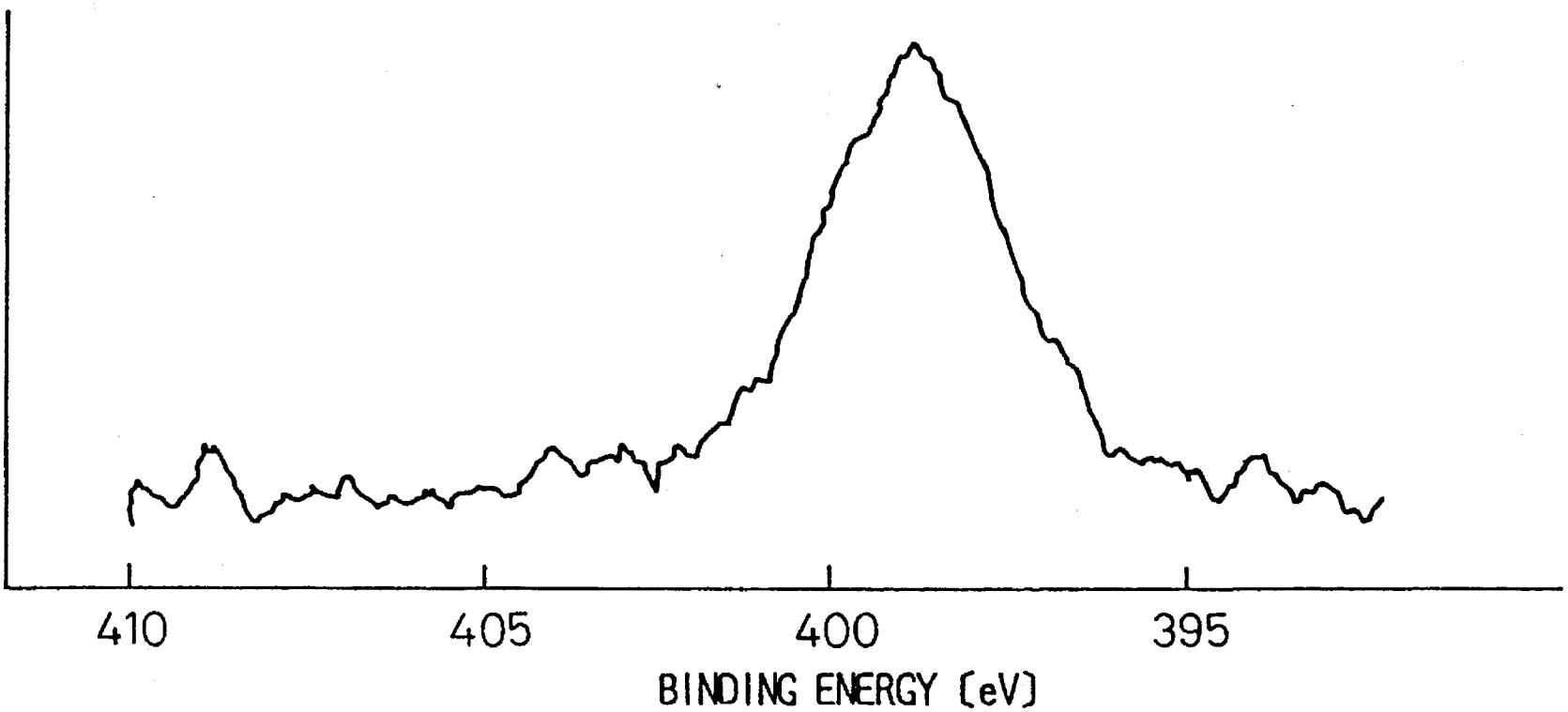
FIG. 3 is a graph of the spectroanalysis of the infusible fiber after carbonization.

As shown in FIG. 2, when the changes in the Nls orbit are viewed by an XPS (X-ray Photoelectron Spectra), it is seen that the infusible fiber just obtained has a peak (30 minutes of carbonization at 300° C.) near 405 eV, showing the content of $NO_2$. In FIG. 3, the peak disappears and the process is stabilized by performing the carbonization (30 minutes carbonization at 380° C.) at least at 350° C. for at least 10 minutes.

Therefore, the nitrogen compound near 405 eV produced by the infusibilization has to be carbonized at a certain temperature and over a certain time as with the primary carbonization in the present invention. If not, rapid carbonization results in fusing and rigidity of the fibers.

It should be noted that, when the temperature of the secondary carbonization is lower than 800° C., the strength of the secondary carbonized yarn is low and handling in the next graphitization process is difficult. Further, when over 1300° C., the modulus of elasticity of the secondary carbonized yarn becomes larger and the problem arises of fluff etc. when taking up the secondary carbonized yarn on a bobbin. The secondary carbonized yarn may be graphitized as needed.

By setting the above production conditions to obtain the secondary carbonized yarn, the productivity in the next process, that is, the graphitization process, is extremely improved. With a pitch-based carbon fiber, however, since the fragile pitch fiber is produced as the starting material, there are inevitably defects in the carbonized yarn, for example, fusing of fibers together or rigidity, damage to part of the fiber yarn, and some breakage. It is extremely difficult to eliminate such portions.

Therefore, according to another aspect of the present invention, before the secondary carbonized yarn is stored in the can or other storage container or wound up on a bobbin, the yarn is examined visually or by an optical detection apparatus to detect partial defects in the fiber yarn, the yarn is forcibly cut there, and the damaged portions are removed, thereby enabling carbonized yarn completely free of damage to be supplied to the next process, that is, the graphitization process. This enables the productivity of the graphitization process to be further improved and, as a result, the productivity of the carbon fiber product to be remarkably improved.

According to still another aspect of the present invention, the pitch fiber yarn made using mesophase pitch as a material is first subjected to an infusibilization in an oxidizing gas atmosphere containing nitrogen dioxide and oxygen, then the infusible oxidized fiber yarn is subjected to primary carbonization at 350° C. to less than 400° C. for at least 10 minutes, preferably 15 to 90 minutes, in an inert gas atmosphere.

The secondary carbonization is then performed at a sintering temperature of 800° to 1300° C., preferably 1000° to 1200° C., in an inert gas atmosphere, at which time the sintering is performed, while applying a tension of 50 to 2500 gf/mm$^2$, preferably 50 to 1,000 gf/mm$^2$, more preferably 60 to 800 gf/mm$^2$, whereby it becomes possible to even out the shrinkage in the longitudinal direction of the fibers caused at a carbonization temperature of 400° C. or more, and therefore, it becomes possible to obtain a yarn with an improved alignment.

When the tension at the time of the secondary carbonization is less than 50 gf/mm$^2$, the alignment of the yarn fiber is not sufficiently improved, while when over 2500 gf/mm$^2$, the yarn easily breaks during the secondary carbonization or a larger amount of fluff is caused. When the treatment temperature of the secondary carbonization is less than 800° C., the strength of the secondary carbonized yarn becomes smaller than 15 kgf/mm$^2$ and it becomes difficult to apply a tension enough to improve the spreading ability in the next process, that is, the graphization process.

Next, at the graphization process (in the present invention, the carbonization and graphitization after the secondary carbonization are referred to all together as "graphitization" and the resultant fiber is referred to as the "carbon fiber"), the secondary carbonized fiber yarn is sintered continuously in an inert gas atmosphere in a graphitization furnace raised in temperature from the less than 1300° C. to a maximum temperature of 1500° C. or more, preferably 1800° C. or more, while applying a tension of 1.5 to 10 kgf/mm$^2$, preferably 1.5 to 7.5 kgf/mm$^2$, whereby it becomes possible to obtain a high grade carbon fiber superior in spreading ability.

Unless the graphitization is performed from a temperature of less than 1300° C., where the fiber still tries to shrink, while applying tension and, further, the maximum temperature reached is made more than 1500° C., it is difficult to align the fibers enough to improve the spreading ability. Further, if the tension at this time is less than 1.5 kgf/mm$^2$, the tension applied is insufficient, while when over 10 kgf/mm$^2$, the tension applied is excessive and the yarn frequently breaks in the graphitization furnace, so this is not preferred. The time required for the graphitization is usually 5 seconds to two minutes or so at 1500° C. or more.

It should be noted that the secondary carbonization furnace and graphitization furnace are independent. It is possible to take up the fiber on a bobbin or store it in a storage container once in the secondary carbonization furnace and then feed out the fiber to the graphitization furnace, or possible to arrange the secondary carbonization furnace and graphitization furnace in series and change the tension of the fiber yarn between them by rollers etc.

Figure 4:
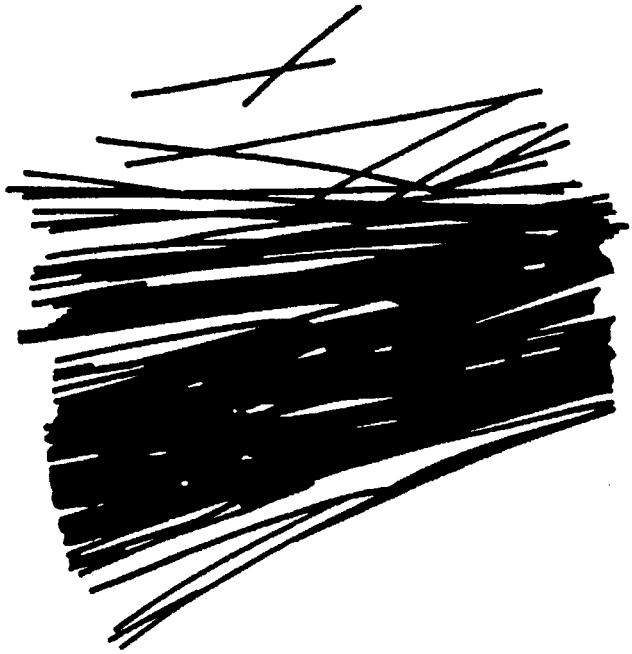
FIG. 4 is a plane view showing the spreading ability of the carbon fiber according to the present invention.
Figure 5:
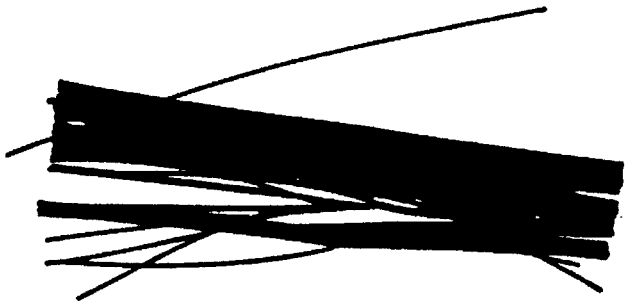
FIG. 5 is a plane view showing the spreading ability of the carbon fiber according to the prior art.

FIG. 4 shows the results of a test of the spreading ability of the carbon fiber obtained by the process of the present invention, while FIG. 5 shows that of the carbon fiber obtained by the prior art process.

In the test, the carbon fiber yarn was cut into lengths of 5 cm, the fibers were placed in a laboratory dish having filter paper laid at its bottom, methylethylketone solution was poured in, then the dish was lightly shaken and the filter paper was lifted out. The opening state of the fibers spread on the filter paper was observed.

Figure 6:
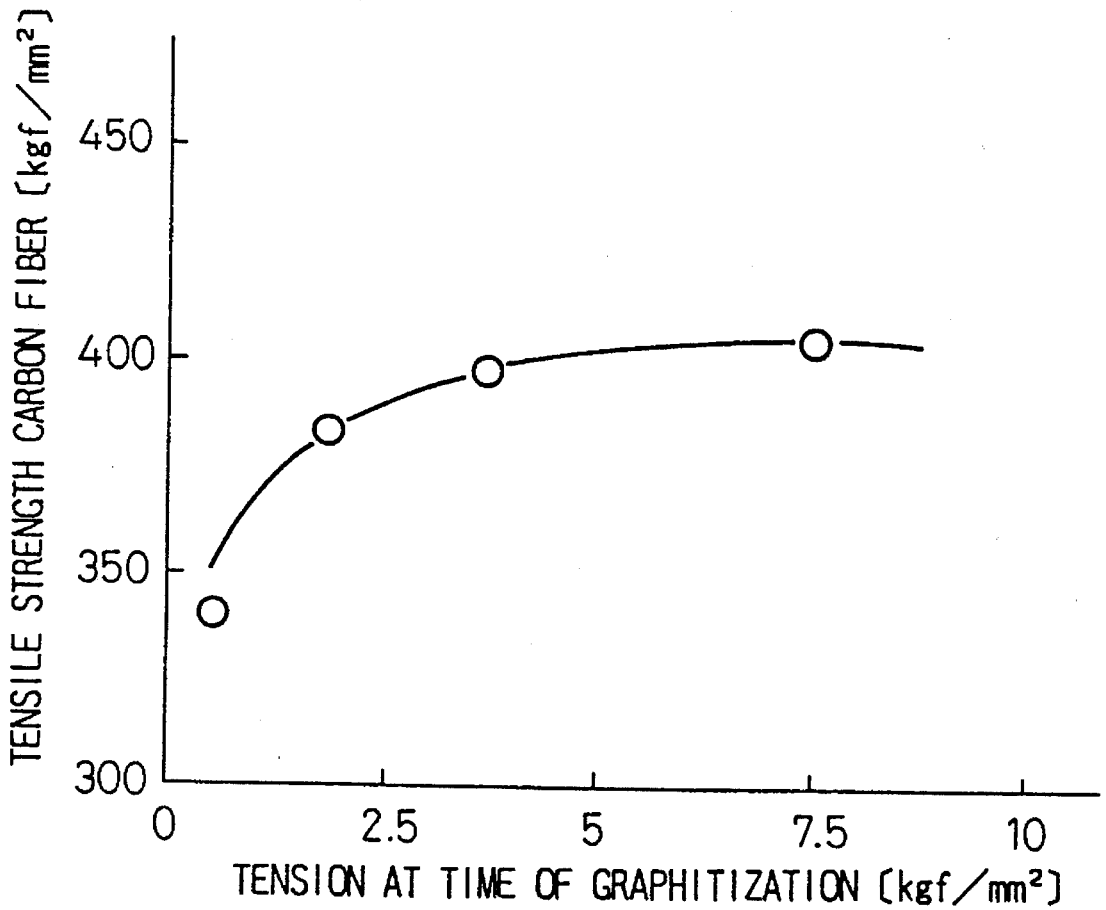
FIG. 6 is a graph illustrating the relationship between the tension at the time of graphitization and the tensile strength of the carbon fiber.

It was learned that the carbon fiber yarn obtained in the present invention had a better spread of the fibers compared with the prior art method and that the fibers were free of entanglement and fusing and were superior in spreading ability. In the same way, FIG. 6 shows the relationship between the tensile strength of the carbon fiber obtained in the present invention and the tension at the time of the graphitization. It was learned that the fiber obtained with a tensile strength at the time of graphitization of 1.5 kgf/mm$^2$ is remarkably improved in the tensile strength and that a high grade carbon fiber can be obtained.

EXAMPLES

The present invention will now be explained in more detail using Examples and Comparative Examples. In the present invention, the physical values used for expressing the properties of the pitch-based carbon fiber and starting pitch were measured by the following methods:

(1) Softening Point

The softening point is the temperature when the apparent viscosity calculated from the Hagen Poiseuille equation using a flow tester became 20,000 poises.

(2) Toluene Insoluble Matter and Pyridine Insoluble Matter

The toluene insoluble matter and pyridine insoluble matter were measured by the method described in JIS (i.e., Japanese Industrial Standards)-K-2425 (1978).

(3) Filament Elongation at Break and Graphitized Fiber Strength and Modulus

These were measured by the methods described in JIS-R-7601 (1986).

(4) Breaking strength of Fiber Yarn

The breaking strength of the fiber yarn was determined by preparing a large number of specimens comprising yarn composed of 3000 filaments with tabs affixed by adhesive at the two ends of the fiber yarn to give a measurement length of 1 meter, then applying tension to the sample at a tensile rate of 50 mm/min and determining the tensile breakage load.

(5) Tensile Strength and Tensile Modulus of Carbon Fiber

The strength of the carbon fiber was measured by the resin impregnated strand method described in JIS-R-7601 (1986).

Example 1

As a starting material, coal tar pitch having quinoline insoluble matter removed therefrom and having a softening point of 80° C. was subjected to direct hydrogenation using a catalyst.

This hydrogenated pitch was heat treated under ordinary pressure at 480° C., then the low boiling point matter was removed to obtain a mesophase pitch. This pitch had a softening point of 304° C., a toluene insoluble matter of 85% by weight, a pyridine insoluble matter of 40% by weight, and a mesophase content of 95%.

This pitch was used to spin a pitch fiber having a fiber diameter of 13 μm at a mesophase pitch viscosity of 800 poises using a spinning machine having a nozzle pack with a capillary diameter of 0.14 mm and 3000 nozzle holes. This pitch fiber was bundled by an air sucker without using a lubricant to make a yarn and was stored in a can.

This pitch fiber yarn was heated, while stored in the can, from 150° C. to 300° C. at a rate of 1° C./min, while blowing, from the bottom of the can, an oxidizing gas composed of air and 5% by volume of nitrogen dioxide and 5% by volume of steam and then was held in that state at 300° C. for 30 minutes to obtain the infusible fiber.

The can storing the infusible fiber was placed as it is in a nitrogen gas atmosphere and the infusible fiber was heated at 10° C./min. The temperature was raised at a temperature shown in FIG. 1 in the range of 300° C. to 600° C. and that temperature was held for 30 minutes for the primary carbonization.

The results of measurement of the elongation at break of the filaments of the thus fiber obtained and the breaking strength of the fiber yarn having a length of 1 meter are shown in FIG. 1.

The above-mentioned primary carbonized yarn was fed out in the linear form from the can and passed through a furnace at an inlet temperature of 500° C., and an outlet temperature of 1100° C., and a length of 2 meters at a speed of 4 m/min. The secondary carbonized fiber thus obtained was wound up on a bobbin.

The secondary carbonized fiber was then graphitized at a temperature of 2300° C., while being unwound from the bobbin to obtain the graphitized fiber.

Fiber with a primary carbonization temperature of less than 350° C. resulted in a rigid yarn and yarn breakage at the time of secondary carbonization.

On the other hand, fiber with a primary carbonization temperature of 350° C. or more was free from yarn rigidity, but fiber with a primary carbonization temperature of 400° C. or more resulted in a graphitized fiber with a large amount of fluff. Fiber of a primary carbonization temperature of 350° C. to 390° C. was free from fiber fluff and gave a beautiful graphitized fiber.

Examples 2 to 4 and Comparative Examples 1 to 2

A primary carbonized fiber obtained in the same way as in Example 1 was passed through a furnace at an inlet temperature of 500° C., an outlet temperature of 1100° C., and a length of the nitrogen gas atmosphere chamber of 2 meters, while being fed out from the can at a tension of 100 gf/mm$^2$ and speed of 4 m/min to perform the secondary carbonization. The resultant secondary carbonized fiber was wound up on a bobbin.

Fiber with a primary carbonization temperature of less than 350° C. resulted in a rigid yarn and yarn breakage at the time of secondary carbonization. On the other hand, fiber with a primary carbonization temperature of 350° C. or more was free from yarn rigidity, but fiber with a primary carbonization temperature of 400° C. or more resulted in a secondary carbonized fiber with an extremely large amount of fluff.

Figure 7:
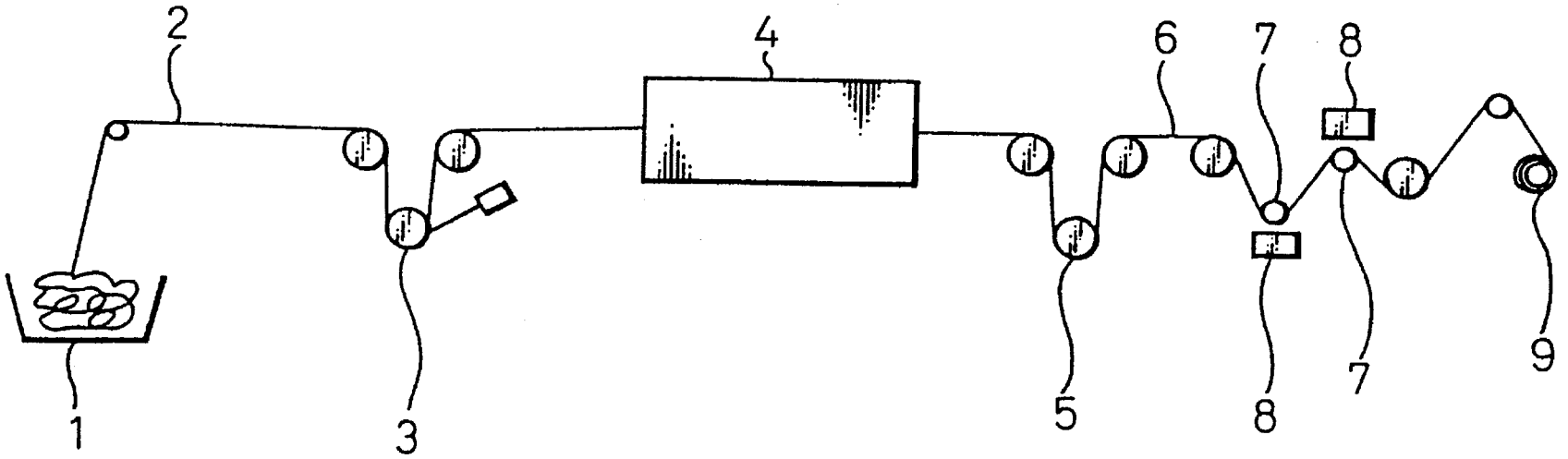
FIG. 7 is a view showing an example of the production process of Example 2 etc. of the present invention.
Figure 8:
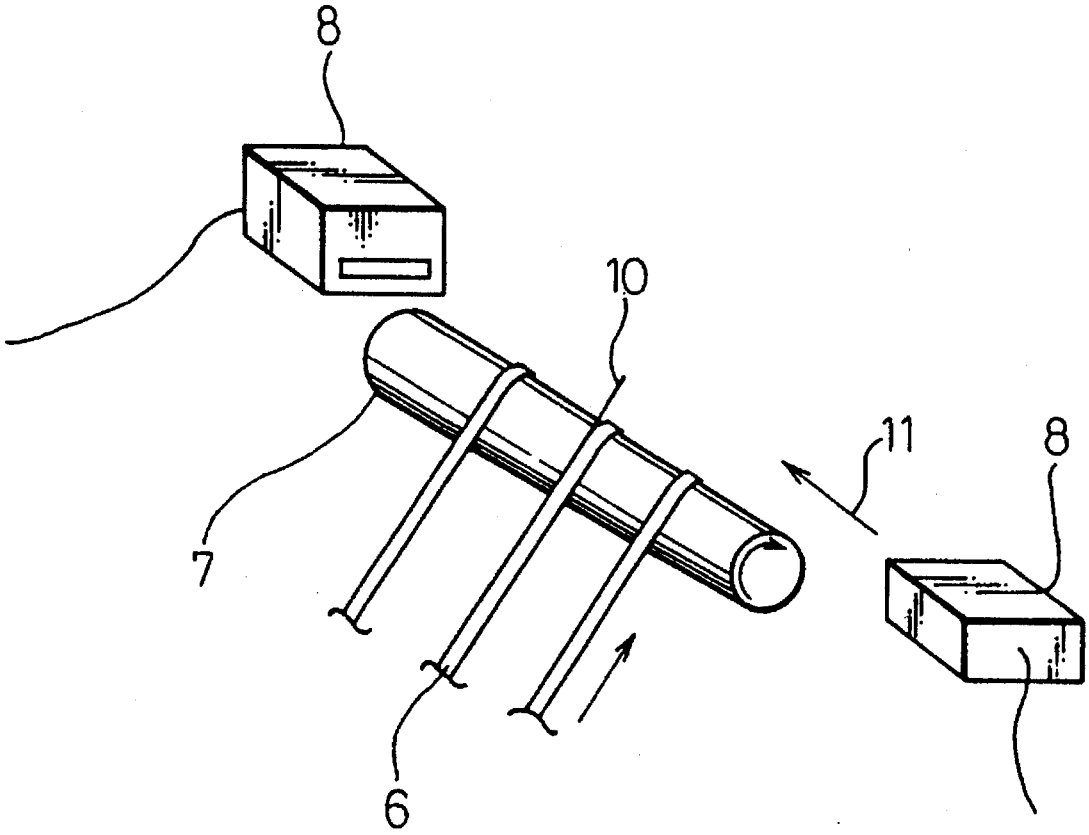
FIG. 8 is a view explaining the yarn damage detector used in Example 2 etc. of the present invention.

Next, fiber of a primary carbonization temperature of 390° C. was subjected to secondary carbonization, while changing the tension. As shown in FIG. 7, the primary carbonized fiber 2 fed out from the can 1 was given tension by a dancer roller 3 and passed into a secondary carbonization furnace 4. Between the furnace outlet and the winder for winding the yarn on the bobbin 9, the yarn was wound on rolls 7 having a diameter of 20 mm by a feed roller 5 at an angle of approximately 90 degrees. As shown in FIG. 8, a yarn damage detector 8 was placed above this roll so as to detect yarn damage 10 such as partial breakage of the yarn or rigid portions using laser light 11. After passing through this at two locations, the secondary carbonized fiber 6 was wound up on a bobbin 9. Thereafter, the secondary carbonized fiber 6 was unwound from the bobbin and subjected to graphization at a temperature of 2300° C. in an argon gas atmosphere for 30 seconds, while being given a tension of 300 gf/mm$^2$ so as to obtain a graphitized fiber.

The results are shown in Table 1 and Table 2.

TABLE 1

| No. | Tension of secondary carbonization (gf/mm$^2$) | Average length passed *1 (km) | Strength of graphitized fiber (kgf/mm$^2$) *2 | Modulus (tf/mm$^2$) |
|---|---|---|---|---|
| Comp. Ex. 1 | 10 | 20 or more | 390 | 50 |
| Ex. 2 | 100 | 20 or more | 420 | 52 |
| Ex. 3 | 500 | 15 | 425 | 53 |
| Ex. 4 | 1000 | 10 | 425 | 53 |
| Comp. Ex. 2 | 3000 | 1 | 425 | 53 |

*1 Average length able to be continuously passed without breakage in the furnace at the time of secondary carbonization.
*2 Yarn alignment was poor and formation of resin impregnated strands was poor.

TABLE 2

| | Average length passed *1 |
|---|---|
| Damaged portions of yarn removed after secondary carbonization (second carbonization tension of 100 gf/mm$^2$) | 10 km or more |

TABLE 2-continued

| | Average length passed *1 |
|---|---|
| Yarn damage not detected during secondary carbonization (secondary carbonization tension of 100 gf/mm$^2$) | 1.8 km |

*1 Average length able to be passed continuously without breakage in the furnace at time of graphitization.

Examples 5 to 10 and Comparative Examples 3 to 6

A primary carbonized fiber obtained in the same way as in Example 1 was passed through a furnace at an inlet temperature of 500° C., an outlet temperature of 1100° C., and a length of the nitrogen gas atmosphere chamber of 2 meters, while being fed out from the can in the linear form at a tension of 100 gf/mm$^2$ and speed of 4 m/min to perform the secondary carbonization at 1100° C. for 10 seconds. The resultant secondary carbonized fiber was wound up on a bobbin.

Fiber with a primary carbonization temperature of less than 350° C. resulted in a rigid yarn and yarn breakage at the time of secondary carbonization. On the other hand, fiber with a primary carbonization temperature of 350° C. or more was free from yarn rigidity, but fiber with a primary carbonization temperature of 400° C. or more resulted in a secondary carbonized fiber with an extremely large amount of fluff.

Next, primary carbonized fiber of a primary carbonization temperature of 390° C. was used as a starting material and subjected to secondary carbonization and graphitization. The conditions of the secondary carbonization were a constant inlet temperature of 500° C., an outlet temperature changed between 700° to 1400° C., and heat treatment for 10 seconds.

The secondary carbonization was performed with a tension at this time of 100 gf/mm$^2$ and a speed of 4 m/min and the result was taken up on a bobbin.

The graphitization furnance had an inlet temperature of 1000° C., performed heat treatment at a maximum temperature of 1900° C. for 16 seconds, and had an effective length of 1 meter. The secondary carbonized fiber was unwound from the bobbin and sintered in the linear form at a speed of 2 m/min, while changing the tension. The fiber was surface treated and sized and then wound on a bobbin. The tension at the graphitization and the physical properties of the resultant carbon fibers are shown in Table 3.

FIG. 6 shows the relationship between the tensile strength and tension at graphitization of the carbon fibers of Comparative Example 5 and Examples 8 to 10.

Figure 9:
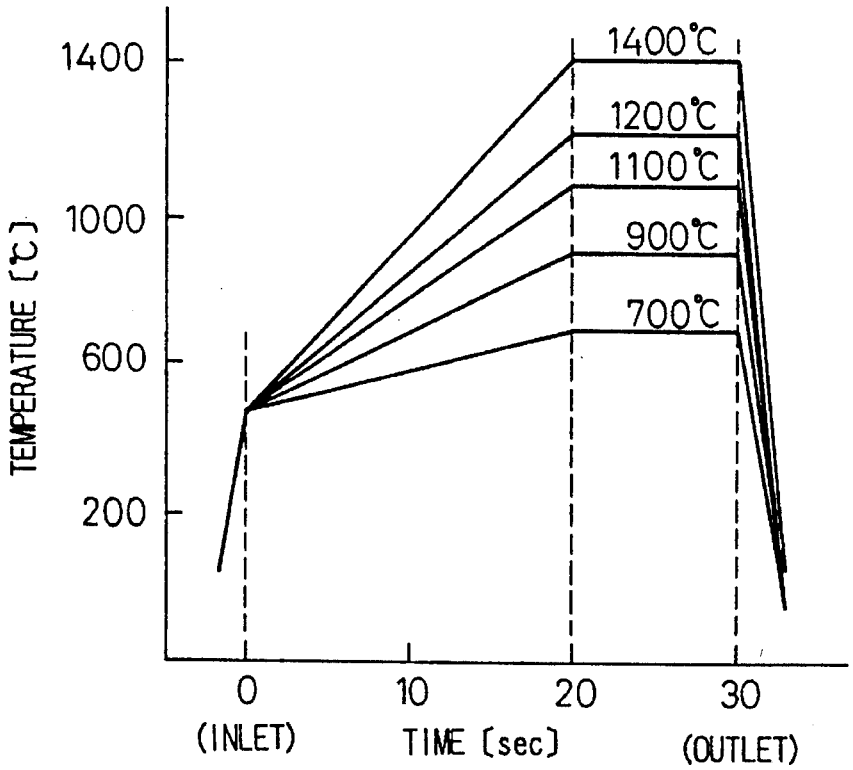
FIG. 9 is a view showing the relationship between the sintering temperature and time of a secondary carbonization furnace in the Examples.
Figure 10:
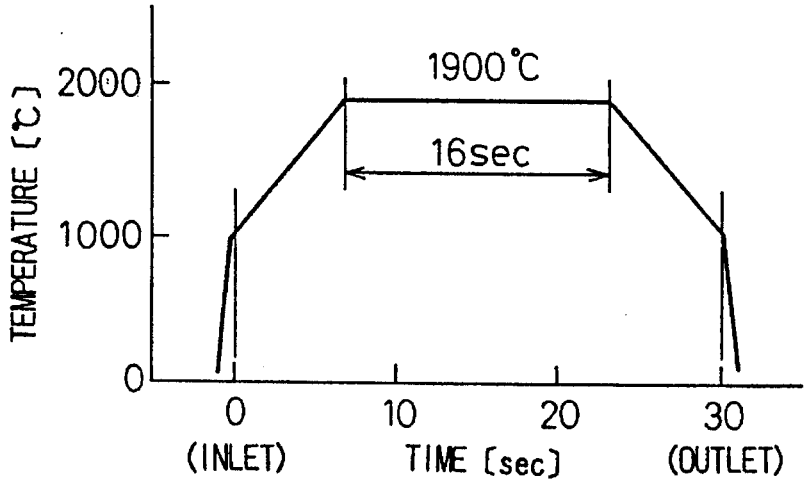
FIG. 10 is a view showing the relationship between the sintering temperature and time of a graphitization furnace in the Examples.

It should be noted that the sintering temperature and time in the secondary carbonization furnace were as shown in FIG. 9. The sintering temperature and time in the graphitization furnace were as shown in FIG. 10.

TABLE 3

| No. | Secondary carbonization outlet temperature (°C.) | Breaking strength of secondary carbonized fiber yarn (kgf/mm$^2$) | Graphitization tension (kgf/mm$^2$) | Carbon fiber tensile strength (kgf/mm$^2$) | Carbon fiber modulus of elasticity (kgf/mm$^2$) | Spreading ability | Remarks |
|---|---|---|---|---|---|---|---|
| Comp. Ex. 3 | 700 | 5 | 3.70 | 395 | 41 | Good | Frequent breakage in graphitization furnace |
| Ex. 5 | 900 | 19 | " | 396 | " | " | No breakage in graphitization furnace |
| Ex. 6*1 | 1100 | 27 | " | 398 | " | " | No breakage in graphitization furnace |
| Ex. 7 | 1200 | 30 | " | 390 | " | " | No breakage in graphitization furnace |
| Comp. Ex. 4 | 1400 | 35 | " | 360 | 38 | Poor | No breakage in graphitization furnace |
| Comp. Ex. 5 | 1100 | 27 | 0.55 | 340 | " | " | No breakage in graphitization furnace |
| Ex. 8 | " | " | 1.85 | 382 | 40 | Good | No breakage in graphitization furnace |
| Ex. 9*1 | " | " | 3.70 | 398 | 41 | " | No breakage in graphitization furnace |
| Ex. 10 | " | " | 7.50 | 405 | " | " | No breakage in graphitization furnace |
| Comp. Ex. 6 | | " | 15.0 | — | — | — | Breakage in graphitization furnace |

*1 Same conditions in Example 6 and Example 9.

As explained above, according to the present invention, it is possible to produce carbon fiber with a good productivity. Also, the resultant fiber is free from fluff and beautiful. In particular, by imparting tension during the secondary carbonization or by removing the damaged portions of the yarn after secondary carbonization, continuous passage of the yarn over a long period is possible, it is possible to produce carbon fiber with a good productivity, and the resultant fiber is free from fluff and beautiful. According to the present invention, it was possible to produce with a good productivity carbon fiber suitable for production of prepregs and superior in spreading ability.

We claim:

1. A method for producing carbon fiber comprising infusibilizing a pitch fiber yarn made using mesophase pitch as a starting material with substantially no tension applied to the yarn and in an oxidizing gas atmosphere including nitrogen dioxide and oxygen; then carbonizing the yarn in an inert gas atmosphere at a temperature of 350° to 390° C. for 10 minutes or more for primary carbonization; then carbonizing the yarn at a temperature of 800° to 1300° C. for 5 to 120 seconds with a tension of 50 to 2500 gf/mm$^2$ applied to the yarn for secondary carbonization, while continuously feeding out the yarn in linear form; thereafter detecting stiff or partially broken portions in the yarn and forcibly cutting said portions to remove said portions from the yarn before the fiber is continuously received by a bobbin or in a receptacle.

2. A method for producing carbon fiber as claimed in claim 1, wherein graphitizing is carried out after the secondary carbonization.

3. A method for producing carbon fiber comprising infusibilizing a pitch fiber yarn, made using mesophase pitch as a starting material, in an oxidizing gas atmosphere including nitrogen dioxide and oxygen; carbonizing the infusible fiber yarn in an inert gas atmosphere at a temperature of 350° to 390° C. for 10 minutes or more for primary carbonization; then carbonizing the yarn at a temperature of 800° to 1300° C. for 5 to 120 seconds with a tension of 50 to 2500 gf/mm$^2$ applied to the yarn for secondary carbonization to obtain a carbon fiber yarn having a breaking strength of at least 15 kgf/mm$^2$; and then continuously graphitizing the carbon fiber yarn at 1500° C. or more, while applying a tension of 1.5 to 10 kgf/mm$^2$ to the carbon fiber yarn.

* * * * *